United States Patent [19]

Sukharevsky

[11] Patent Number: 4,604,889

[45] Date of Patent: Aug. 12, 1986

[54] AUTOMATED INSTALLATION TOOL FOR BLIND FASTENERS

[75] Inventor: Boris P. Sukharevsky, Fullerton, Calif.

[73] Assignee: Huck Manufacturing Company, Irvine, Calif.

[21] Appl. No.: 686,891

[22] Filed: Dec. 27, 1984

[51] Int. Cl.[4] ..... B21D 9/05

[52] U.S. Cl. ..... 72/391; 72/453.17; 227/112

[58] Field of Search ..... 72/391, 453.17, 453.19, 72/412; 29/243.53, 759; 227/104, 105, 107, 112

[56] References Cited

U.S. PATENT DOCUMENTS 3,111,869 11/1963 Goff et al. ..... 72/453.17

3,580,457 5/1971 Henshaw ..... 72/391

3,658,230 4/1972 Enock ..... 227/112

4,044,462 8/1977 Anselmo ..... 29/243.53

*Primary Examiner*—Francis S. Husar

*Assistant Examiner*—David B. Jones

*Attorney, Agent, or Firm*—Harness, Dickey & Pierce

[57] ABSTRACT

A portable blind fastener installation tool having an installation section actuable for setting the blind fastener and a fastener loading section for automatically front, loading the fastener into the installation section and a piston-valve section for reciprocating the installation section away from and back to its fastener setting position after a fastener has been set to permit the fastener loading section to be moved to a position in front of the installation section while it is away from its fastener setting position whereby the next fastener will be front loaded into the installation section on its movement back to its fastener setting position.

32 Claims, 10 Drawing Figures

Fig-2
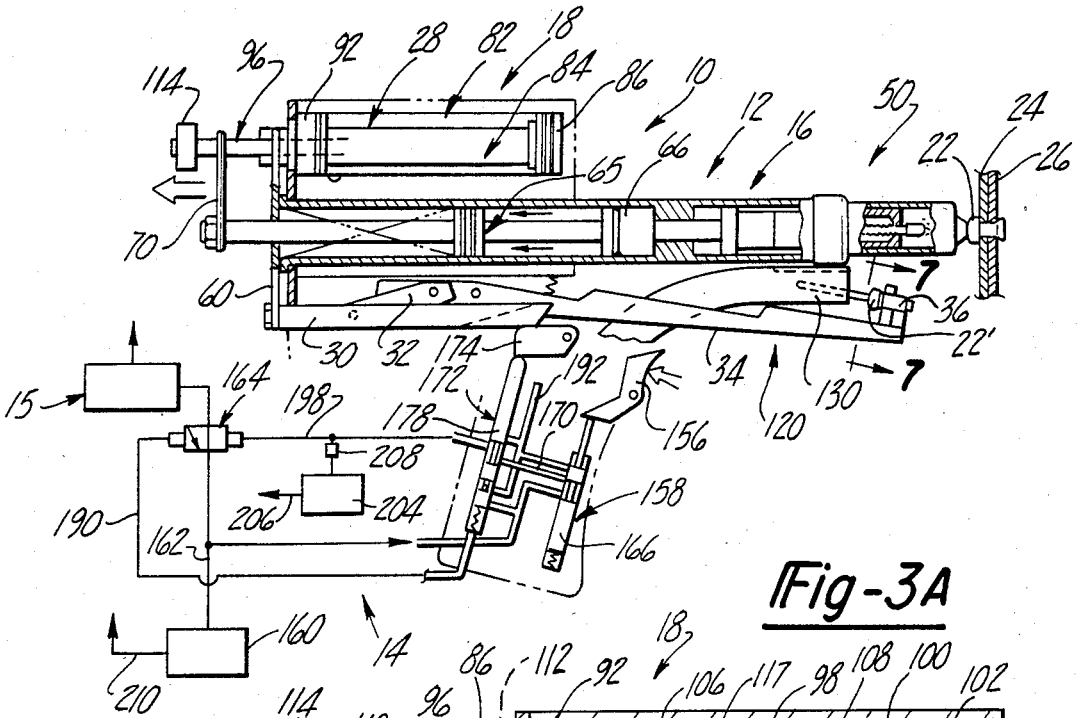
Fig-3A
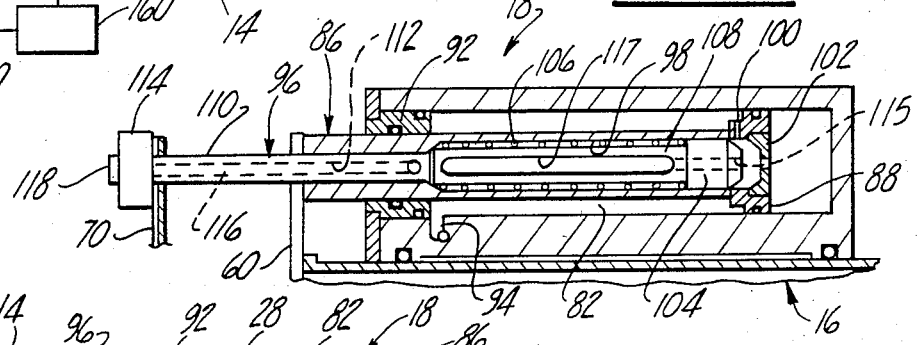
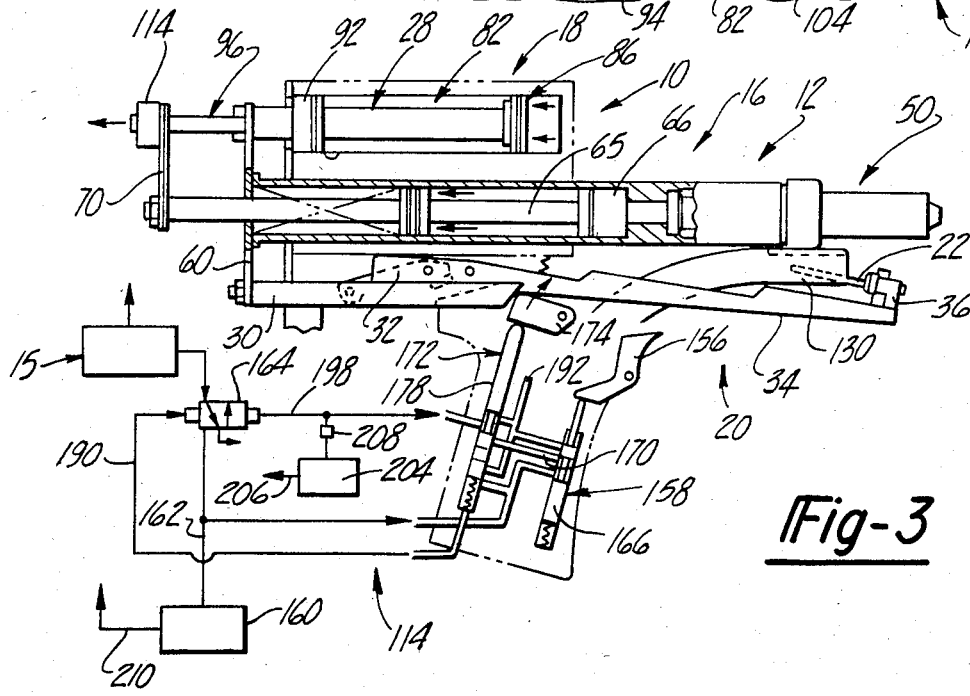
Fig-3

Fig-4
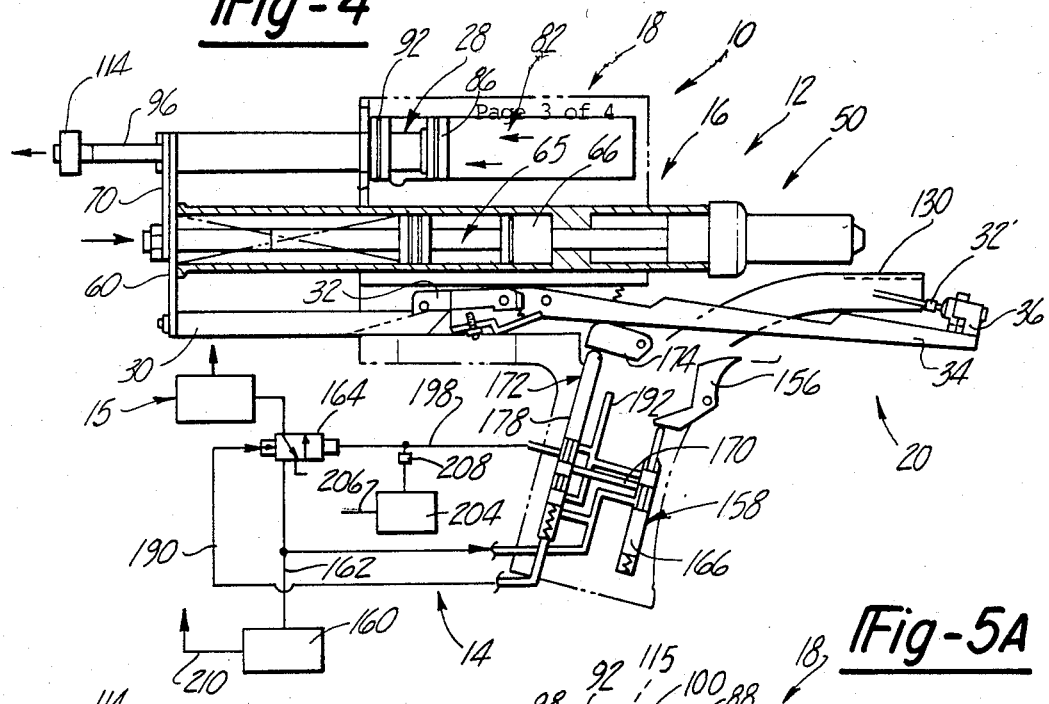
Fig-5A
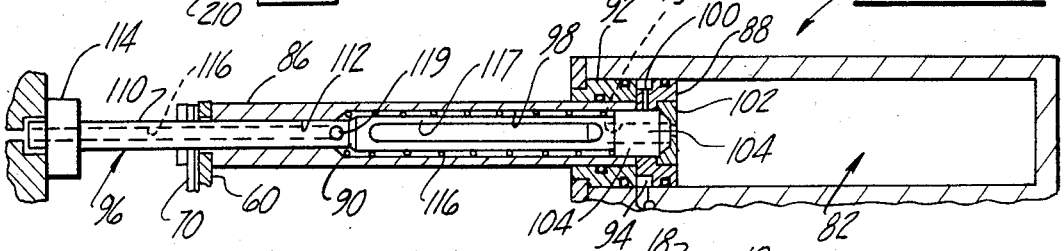
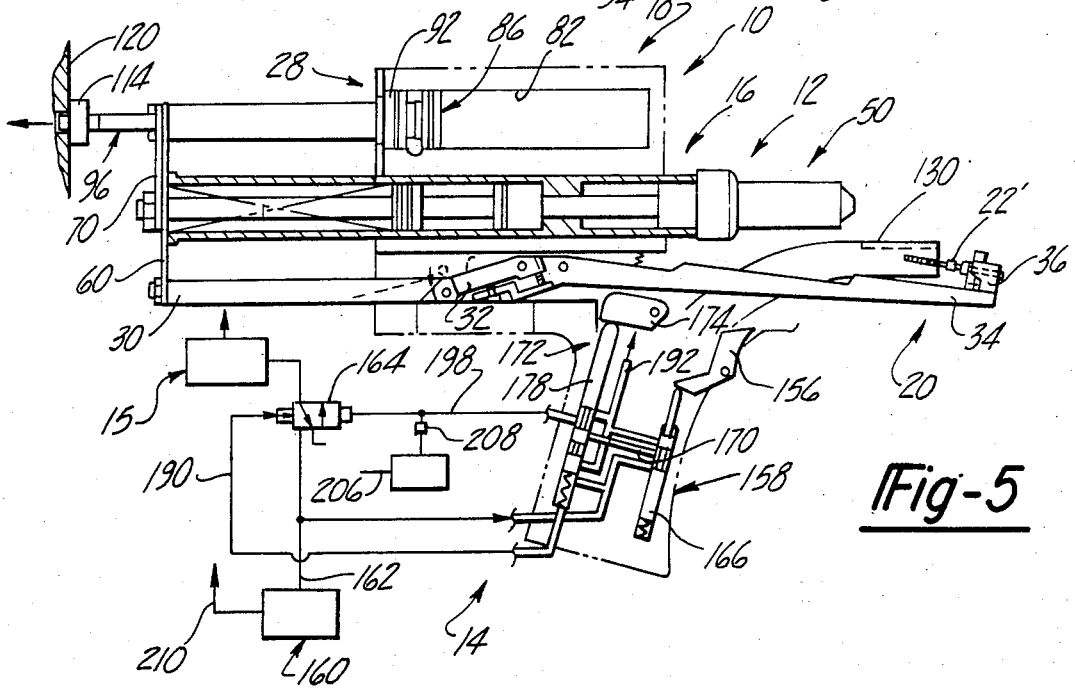
Fig-5

AUTOMATED INSTALLATION TOOL FOR BLIND FASTENERS

SUMMARY BACKGROUND OF THE INVENTION

The present invention relates to apparatus for installing blind fasteners and more particularly to apparatus for automatically feeding blind fasteners for front loading to the nose assembly of an installation section of the tool for rapid, successive installation of such fasteners.

It is desirable in the installation of blind fasteners by a manually operated tool to be able to repetitively install successive fasteners without the need for the manual insertion of the fastener into the tool. Automatic load devices have been provided in the past having complex splitting arm structures for presenting the fasteners to the tool. Other types utilize a slot in the nose assembly of the tool or have a split nose type structure. Both of the latter could adversely affect the integrity of the tool.

In the present invention a relatively simple construction is provided whereby fasteners can be effectively, repetitively front loaded into the nose assembly of the tool without affecting the integrity of the tool. At the same time, the simple construction is compact permiting an efficient utilization of space. One of the features of the invention is a construction in which the nose assembly of the tool reciprocates relatively to the tool housing whereby the fastener load mechanism need only be pivoted in front of the nose portion in its retracted position to present a fastener which will be picked up, by the nose assembly as it moves back to its advanced position. After the fastener has been picked up, the load mechanism simply pivots away from the nose assembly which, in the advanced position, is ready to install the fastener. After the fastener is set the cycle automatically repeats itself.

The load mechanism of the tool operates to receive a fastener from a feed mechanism in readiness to be picked up by the nose assembly; this occurs while the tool is setting the prior fastener and permits for rapid cycling of the tool. By initiating the feed step simultaneously with the actuation of the tool to set the fastener the maximum amount of time is provided to recondition the feeding mechanism for the next feed step.

Therefore, it is an object of the present invention to provide a novel, automated fastener installation tool having an automated feed mechanism which is compact and simple in construction.

It is another object of the present invention to provide a novel, automated fastener installation tool having a reciprocable nose assembly and a pivotal feed mechanism for automatically front loading fasteners to the nose assembly.

It is a further object of the present invention to provided a tool of the above described type in which the nose assembly reciprocates between retracted and advanced positions in picking up a fastener from the load mechanism which pivots in front of and away from the nose assembly to effect the fastener pick up.

It is still another object to provide an automated fastener installation tool of the above described type having means for feeding a new fastener into the load mechanism simultaneously with actuation of the tool for setting the preceding fastener.

It is a general object to provide a new and improved automated fastener installation tool.

Other objects, features, and advantages of the present invention will become apparent from the subsequent description and the appended claims, taken in conjuction with the accompanying drawings, in which:

FIG. 2 is a generally diagrammatical elevational view of the apparatus of FIG. 1 depicting it in a condition operable to actuate a fastener installation section to install the blind fastener and with another blind fastener having been fed to a fastener load section by the feed apparatus;

FIG. 3 is a generally diagrammatical elevational view of the apparatus of FIG. 1 depicting it in a condition in which a pneumatic reciprocating valve section has been actuated by the fastener installation section;

FIG. 3A is a fragmentary sectional view showing the pneumatic reciprocating valve section in its actuated condition;

FIG. 4 is a generally diagrammatical elevational view of the apparatus of FIG. 1 depicting it in a condition in which the pneumatic reciprocating valve section has been actuated to move the fastener installation section to a retracted position relative to the fastener load section;

Figure 1:
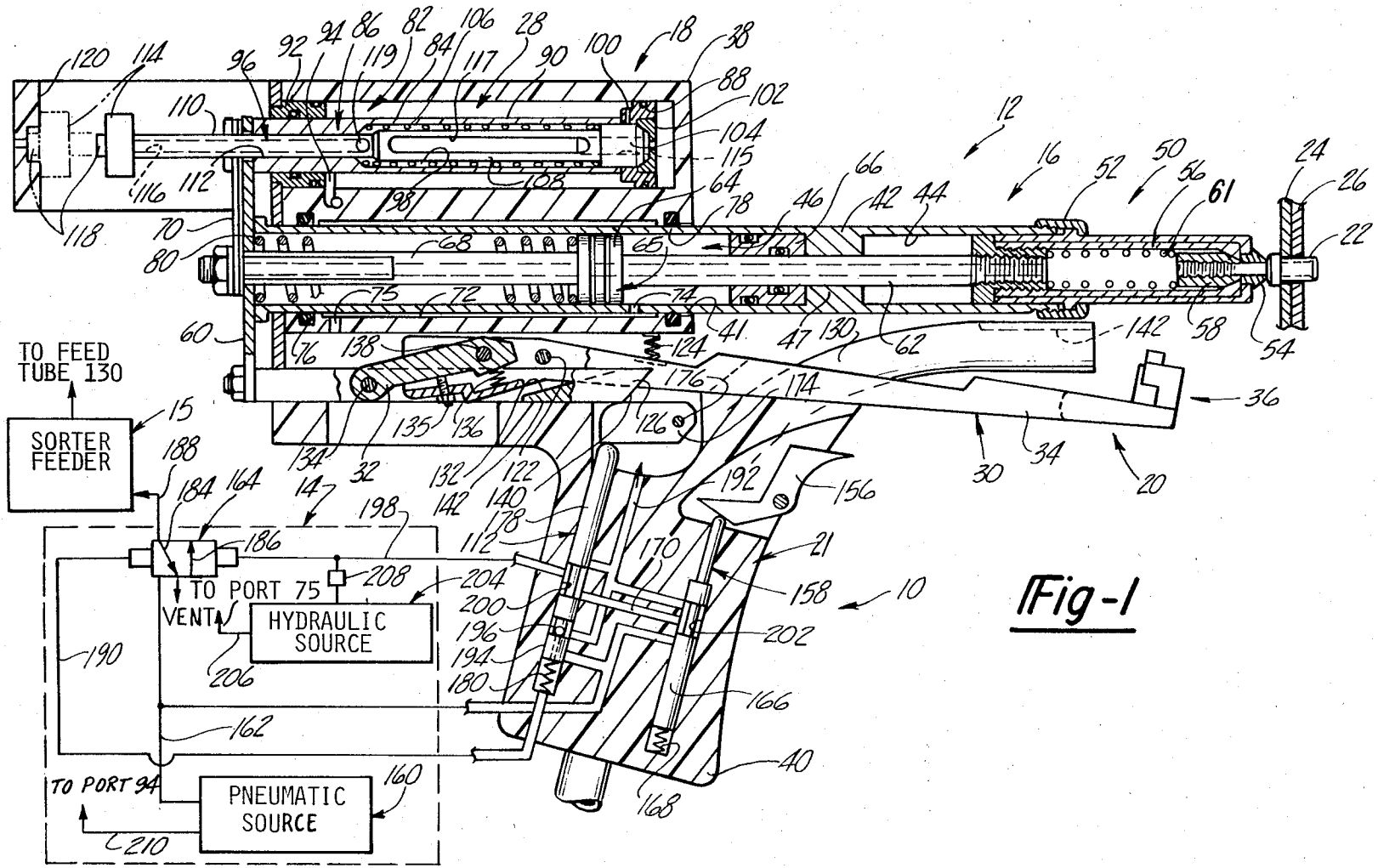
FIG. 1 is a longitudinal, sectional view of the automated installation tool assembly of the present invention with its associated pneumatic-hydraulic operating circuit shown generally in schematic form and with the tool assembly and operating circuit shown in a condition in which a blind fastener is ready to be installed.
Figure 6:
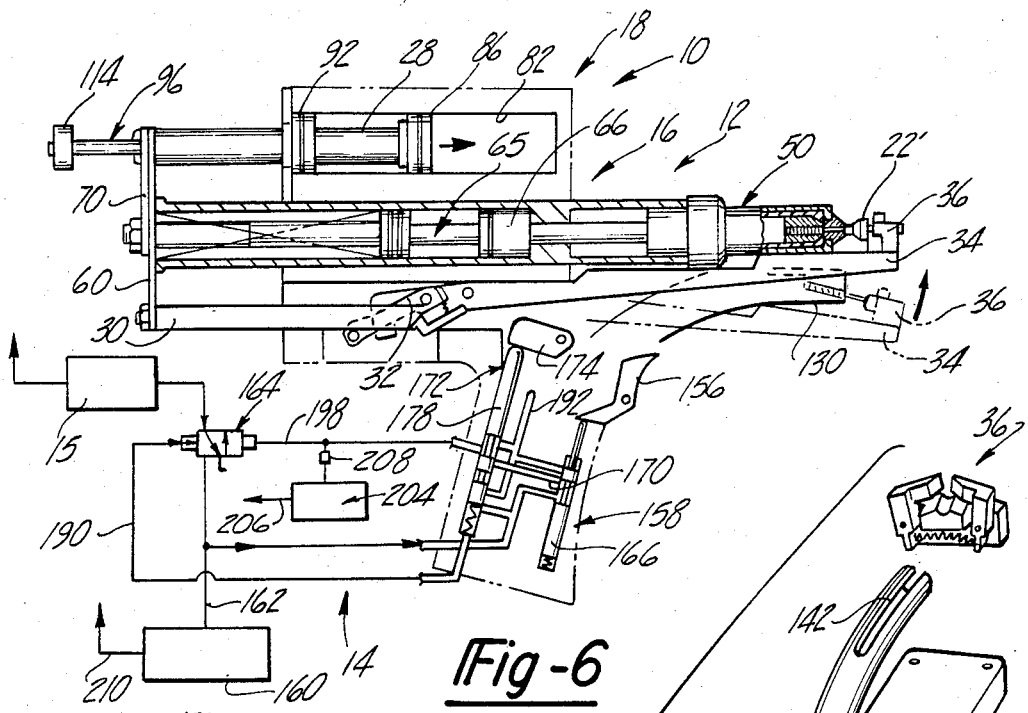
Figure 7:
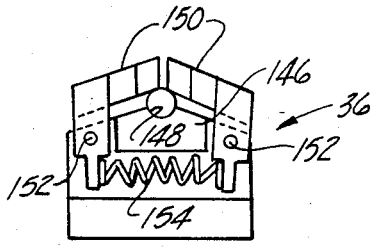
Figure 8:
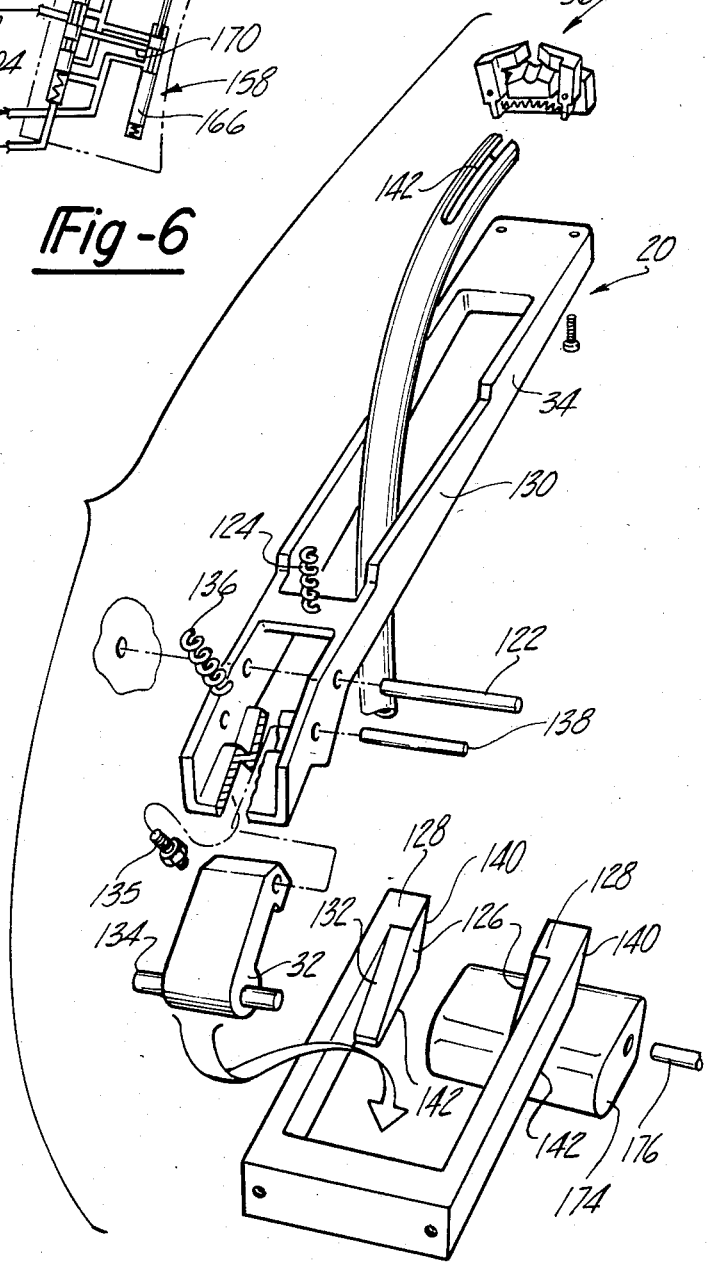

FIG. 5 is a generally diagrammatical elevational view of the apparatus of FIG. 1 depicting it in a condition in which a cam type apparatus is conditioned to actuate the fastener load section to present the next fastener to the fastener installation section and in which the pneumatic reciprocating valve section has been actuated to a condition to initiate the return of the fastener installation section to its original position;

FIG. 5A is a fragmentary sectional view showing the pneumatic reciprocating valve section in its condition to initiate the return of the fastener installation section to its original position;

FIG. 6 is a generally diagrammatical elevational view of the apparatus of FIG. 1 depicting it with the fastener load section actuated to a condition in which the blind fastener is presented to the fastener installation section for pick up as the latter section is returned to its original position of FIG. 1;

FIG. 7 is a view taken generally in the direction of the arrows 7—7 in FIG. 2 depicting, to enlarged scale, a fastener catcher assembly of the fastener load section; and FIG. 8 is an enlarged, exploded view of one form of cam type apparatus for actuating the fastener load section and for operating on the pneumatic-hydraulic circuit.

The system as shown is specifically adapted to install two piece fasteners of the 'pop' rivet type or of a type as shown in the U.S. Pat. No. 3,288,016 issued Nov. 29, 1966 to Reynolds for "Blind Two-Piece Fastener" or as shown in the copending U.S. patent application of Smith Ser. No. 425,304, filed Sept. 28, 1982 for "Two Piece Blind Fastener With Lock Spindle". Generally the blind fasteners comprise a pin and a sleeve with the sleeve having an enlarged head adapted to engage the outer surface of workpieces to be secured and a shank adapted to extend to the inner or blind surface of the workpieces. The pin typically has an enlarged head adapted to engage the sleeve shank whereby the sleeve shank will be upset to form a blind head in response to a relative axial force applied between the pin and the sleeve. Conventionally the pin has a weakened portion or breakneck groove at which the pin will sever upon completion of the installation.

Looking now to the drawings, a blind fastener installation tool system 10 is shown and includes an installation tool assembly 12, an associated pneumatic-hydraulic circuit 14 and a fastener sorter-feeder mechanism 15. In general the tool assembly 12 is manually operable and includes the following:

(a) a hydraulically actuated fastener installation section 16, (b) a pneumatically actuated reciprocating valve section 18, and (c) a mechanically actuated fastener load section 20.

The sections 16, 18 and 20 are all supported by a common tool housing 21. In general, the system 10 operates the various sections in a preselected sequence in order to effectuate the automatic insertion of blind fasteners into the installation section 16 by the load section 20 in readiness for successive installations. Thus FIG. 1 depicts the system 10 in a condition ready to install a blind fastener 22 to a pair of workpieces 24 and 26 to be joined.

FIG. 2 shows the system after it has been actuated to set the fastener 22; at the same time a new fastener 22' has been fed to the fastener load section 20. Next, as shown in FIGS. 3 and 3A, a portion (to be described) of the installation section 16 actuates the reciprocating valve section 18. The reciprocating valve section 18 has a piston-valve assembly 28 fixed to the installation section 16 and as shown in FIG. 4 retracts or moves the installation section 16 rearwardly relative to the tool housing 21. The fastener load section 20 has a cam arm 30 which is also fixed to move together with the piston-valve assembly 28 and the installation section 16 and, in its retracted position shown in FIG. 5, permits a cam follower 32 to be set to an actuable position. The cam follower 32 is pivotally secured to a catcher arm 34 which in turn is pivotally secured to the tool housing 21. Both the cam follower 32 and catcher arm 34 are a part of the load section 20.

The catcher arm 34 teminates in a catcher assembly 36 which, as shown in FIG. 2, has received the next blind fastener 22' to be front loaded and installed. At the end of the rearward stroke of the piston-valve assembly 28, valve shift occurs (in a manner to be described) which reverses the movement of the piston-valve assembly 28 (see FIG. 5A). This now moves the cam arm 30 and installation section 16 forwardly towards their advanced positions. As this occurs (see FIG. 6), the cam arm assembly 30 engages the cam follower 32 causing the catcher arm 34 to pivot bringing the catcher assembly 36 and blind fastener 22' to a position in front of the installation section 16 for front loading. As the installation section 16 moves forwardly to its advanced position, it picks up the fastener 22'. Continued forward or return movement of the installation section 16 releases the cam follower 32 permitting the catcher arm 34 to pivot downwardly away from the installation section 16 and the latter returns to its original, advanced position of FIG. 1 ready to install the fastener 22'. As will be shown, the catcher assembly 36 has a releasable jaw construction permitting extraction of the fastener 22' by the installation section 16.

It can be seen from the above description that the subject apparatus, while rapid in operation, is of a relatively simple and compact construction. With that general discussion, let us now look to the details of the noted apparatus.

A. THE FASTENER INSTALLATION SECTION 16

Looking mainly to FIG. 1, the tool housing 21 includes a body portion 38 and a handle 40 adapted to be gripped by an operator. Body portion 38 includes a through bore 41 for reciprocably supporting the fastener installation section 16. The installation section 16 includes a generally tubular housing member 42 having front and rear chambers 44 and 46, respectively, separated by a reduced diameter shoulder portion 47.

A nose assembly 50, generally of a conventional construction, is removably secured to the front chamber 44 via a locking cap 52. The nose assembly 50 has a tubular outer anvil member 54 adapted to engage the sleeve head of fastener 22. A tubular collet member 56 is slidably supported within the anvil member 52 and has a plurality of chuck jaws 58 adapted to grip the pin of the fastener 22. The chuck jaws 58 can be moved axially and radially to grip or release the pin and are normally urged forwardly to a radially closed position by a spring 61. As shown in FIG. 1, the jaws 58 are in their forward position gripping the pin of the fastener 22 while the anvil member 54 engages the sleeve head. In operation, the fastener installation section 16 can be selectively actuated to cause the collet member 56 to be moved axially rearwardly applying a relative axial force between the pin and sleeve of fastener 22. As the axial force increases, the head of the pin will upset the inner or blind end of the sleeve shank to form a blind head and a further increase in axial force will fracture the pin at its breakneck groove (see FIG. 2).

The collet member 56 is threadably secured to the end of a first piston rod 62 which extends forwardly from an associated piston head 64 of a pull piston 65. The piston head 64 is annularly sealed relative to and is adapted to reciprocate within the rear chamber 46 with the piston rod 62 extending in clearance relationship through the reduced diameter bore of shoulder portion 48 and being sealingly and slidingly supported on an annular seal ring 66. The seal ring 66 is axially supported against the shoulder portion 48 and provides a radially inner hydraulic seal against the piston rod 62 and a radially outer hydraulic seal against the inside wall of the rear chamber 46. The pull piston 65 has a through bore which permits rearward ejection of the severed portion or pin tail of the pin of fastener 22. The housing member 42, at the end of rear chamber 46, is connected to a connecting plate 60. A second piston rod 68 extends rearwardly from piston head 64 and terminates just beyond the connecting plate 60. A flat, valve actuating spring 70 is fixed at the outer end of the rearward rod 68 and serves a purpose to be described. An elongated annular groove 72 is located in the bore 41 and defines a passageway for hudraulic fluid to and from the forward rod end of the rear chamber 46 via a radial cross bore 74 in the tubular housing 42. A port 75 is adapted to communicate the groove 72 to a source of hydraulic pressure. Annular seals 76 and 78 seal the forward and rearward ends, respectively, of the bore 41 relative to the outer surface of the tubular housing 42. A return spring 80 is biased to urge the pull piston 65 to its forwardmost position.

Thus to install a fastener, the installation section 16 is actuated by the operator whereby hydraulic fluid under pressure from a hydraulic pressure source is communicated to the forward rod end of rear chamber 46 via port 75, bore 74 and groove 72; this will cause the pull piston 65 to be moved rearwardly overcoming the bias of spring 80. At the same time the collet 56 and jaws 58 will be moved rearwardly to apply the relative axial force to set the fastener 22 in the manner previously described. The severed pin tail portion will be ejected rearwardly out from the installation section 16 via the opening through the pull piston 65. Subsequently, when the installation section 16 is deactuated, the magnitude of fluid pressure at the hudraulic pressure source will return to atmospheric or low pressure and the spring 76 will return the piston member 65, collet 56 and jaws 58 to their forwardmost or return positions to accept another fastener to be installed. In returning the pull piston 65 as noted, the spring 80 will cause the fluid in the forward rod end of rear chamber 46 to be returned to the source of fluid pressure via the cross bore 74, passageway 72 and port 75. As noted the passageway 72 is elongated to extend for a substantial portion of the length of associated bore 41. Thus as the installation section 16 reciprocates axially within bore 41, fluid communication between cross bore 74 and passageway 72 will be maintained over the full length of axial travel.

B. THE RECIPROCATING VALVE SECTION 18

The valve section 18 comprises a cylinder 82 defined in the housing 21 with its axis being substantially parallel to that of the installation section bore 41. A differential piston and valve assembly 84 is supported for reciprocable movement within cylinder 82 and includes a piston member 86 having a piston head 88 and a rearwardly extending piston rod 90. The piston rod 90 extends outwardly from the cylinder 82 through a bore in an end cap 92. The end cap 92 is located at the rearward end of cylinder 82 and provides a radially outer pneumatic seal with the cylinder 82 and a radially inner pneumatic seal with the piston rod 90. The outer end of the piston rod 88 is connected to the installation tool section 16 via the connecting plate 60. Thus as the piston and valve assembly 84 moves axially within the cylinder 82, the installation section 16 will be moved axially within the bore 41 relative to the housing 21. A radial cross bore or port 94 connects the rod end of cylinder 82 with a source of air pressure. Thus the piston and valve assembly 84, and hence the installation section 16, will normally be held in its forwardmost position via the communicated air pressure.

The piston and valve assembly 84 includes a valve member 96 which is reciprocably supported within a through bore 98 in piston member 86. A cross port 100 communicates the rod end of cylinder 82 with the piston through bore 98. The through bore 98 terminates in an annular valve seat 102 fixed in a counterbore in piston head 88. The valve member 96 has an enlarged valve head portion 104 adapted to normally engage the seat 102 and to block the cross port 100 to thereby provide a pneumatic seal between the rod end and head end of cylinder 82. A spring 106 located within an enlarged bore portion of the piston through bore 98 urges the valve head portion 104 to its closed position against valve seat 102 and relative to cross port 100.

Valve member 96 has a valve stem portion 108 located within the enlarged bore portion 98 and a reduced diameter stem portion 110 which is slidably supported within and extends through a reduced diameter bore portion 112 of through bore 98. A valve actuating spool 114 is supported on the end of stem portion 110. A central bore 115 extends through the valve head portion 104 and the adjacent portion of the valve stem portion 108 and communicates with the enlarged bore portion of piston through bore 98 via a slot 117. A central bore 116 through the stem portion 110 of valve member 96 is communicated with the enlarged portion of piston through bore 98 via a port 119. Thus the head end of cylinder 82 is communicated with an outlet port 118 associated with valve actuating spool 114 via central bore 115, slot 117, the enlarged portion of piston through bore 98, port 119 and central bore 116. In its normal, deactuated position the spool 114 has outlet port 118 open whereby the head end of cylinder 82 is communicated with atmosphere; in this condition the piston and valve assembly 84 and the installation section 16 which is connected to it will be held in their axially forwardmost positions.

As noted the hydraulic pull piston 65 has a valve actuating spring 70 secured to the end of rearward piston rod 68. The flat spring 70 is adapted to engage the actuating spool 114. Thus when the pull piston 65 approaches the end of its pull stroke the spring 114 will engage the spool 114 moving it to its position closing the outlet port 118. Further movement of the pull piston 65 and flat spring 70 will move the valve member 96 axially rearwardly unseating the valve head portion 104 from the valve seat 102 (see FIG. 3A). At the same time the port 119 will be located within and closed by the reduced diameter portion 112 of through bore 98. Now pneuamtic pressure will be communicated to the head end of cylinder 82 via port 100 and the opening through valve seat 102. Because of the differential in cross-sectional areas between the head end and rod end of piston member 86, there will be a net resultant force applied to the piston member 86 moving it axially rearwardly. At the same time, the valve member 96 will be maintained in its axially rearwardly, unseated position.

Now the piston member 86 will continue to move axially rearwardly retracting with it the installation section 16. The objective here is to move the nose assembly 50 rearwardly sufficiently relative to the catcher assembly 36 such that the assembly 36 with the new fastener 22' can be moved in front of the nose assembly 50 via the pivoting action of the catcher arm 34 (in a manner to be described).

At the end of the rearward stroke of pneumatic piston member 86 the spool 114 engages a shoulder 120 of the housing 21 such that spool 114 is moved to its open position communicating the outlet port 118 with the central bore 116. At the same time, the valve head portion 104 is moved to seat against valve seat 102 closing the communication between the rod end and head end of cylinder 82 (see FIG. 5A). Now the air pressure in the head end of cylinder 82 is vented to atmosphere via central bore 115, slot 117, the enlarged portion of piston through bore 98, port 119, central bore 116 and outlet port 118. In this condition, the pneumatic pressure at the rod end of cylinder 82 will move the piston and valve assembly 84, along with the installation section 16, axially forwardly to their original advanced positions. As will be seen from the discussion which follows, it is this reciprocation of the fastener installation section 16 along with the simultaneous actuation of fastener load section 20 which will place the new fastener 22' in a position to be picked up by the nose assembly 50.

Note that the initiation of the operating cycle of the reciprocating valve section 18 can be caused to occur in response to movement of the pull piston 65 a distance sufficient to provide the necessary relative axial movement to set the fastener 22. By providing actuation at this early point in the installation cycle, the overall cycle time of the tool system 10 can be minimized.

C. THE FASTENER LOAD SECTION 20

As noted, the fastener load section 20 is substantially mechanically actuated. The cam arm 30 is secured to the connecting plate 60 and hence will reciprocate axially along with the piston and valve assembly 84. The catcher arm 34, however, is axially fixed but pivotally secured to the housing 21 via pivot pin 122. With the tool assembly 12 in its deactuated condition (FIG. 1), the forward portion of catcher arm 34 will be pivoted downwardly by the bias of a spring 124 locating the jaws of the catcher assembly 36 away from the nose assembly 50. The cam arm 30 has a cam portion 126 which is located at this time forwardly of the cam follower 32 but will co-act with the follower in response to the noted reciprocation to pivot the catcher arm 34 to and from the desired fastener pickup position. In the initial position shown in FIG. 1, however, the catcher arm 30 is in its lower position away from the nose assembly 50 with the jaws of the catcher assembly 36 in line with a feed tube 130 such as to receive the next fastener 22'.

When the tool assembly 12 is actuated, as noted, the cam arm 30 is retracted; the cam portion 126 has a rearward cam surface 132 which will engage a pin or roller 134 on the cam follower 32 (see FIG. 8 for details). The cam follower 32 is biased to its downward position via a spring 136. As the cam arm 30 moves rearwardly the rearward cam surface 132 upon engagement with pin or roller 134 will pivot the cam follower 32 about a pivot pin 138 upwardly and out of the way (see FIG. 4). At the end of the rearward travel of the cam arm 30, the cam follower 32 will move back to its original position but will now be located forwardly of the cam portion 126 (see FIG. 5). When the cam arm 30 is actuated to move axially forwardly, the pin or roller 134 will engage a forward cam surface 140 on cam portion 126 whereby the cam follower 32 will be moved downwardly against a generally flat, lower cam surface 142 of cam portion 126. This action causes the catcher arm 34 to be pivoted about its pivot pin 122 moving the jaws of the catcher assembly 36 upwardly to a position in front of the nose assembly 50 and holding that position with the fastener 22' in line to be picked up. A set screw 135 can be adjusted to provide the location of the catcher assembly 36 to the desired position.

The feed tube 130 has a slot 144 permitting upward movement of the fastener 22' outwardly therefrom (see FIGS. 1 and 8). The length of the flat lower cam surface 142 is such as to maintain the fastener 22' in the desired position until the fastener pin is inserted into the chuck jaws 58 of nose assembly 50. Subsequently when the lower cam surface 142 moves past the pin or roller 134 the catcher arm 34 is actuated by return spring 124 to quickly pivot the jaws of the catcher assembly 36 downwardly away from the axially forwardly moving nose assembly 50. As will be seen the catcher jaws will be readily pivotally split to release the fastener 22' as the catcher assembly 36 is moved dwonwardly.

With regard to the latter, and looking now to FIG. 7, the catcher assembly 36 includes a cradle 146 having a generally semi-circular seat 148 adapted to matingly receive the shank portion of the sleeve of the fastener (such as 22, 22'). A pair of jaws 150 are supported via pins 152, to pivotally move towards or away from each other. A spring 154 engages jaws 150 to urge them together or into a closed position to overengage and hold the shank portion of a fastener (such as 22, 22'). The bias of spring 154 is relatively light to facilitate insertion of the fastener 22' from the feed tube 130 and to permit easy release after being picked up by the nose assembly 50.

The cam arm 30 is also operative to condition the pneumatic-hydraulic circuit 14 (in a manner to be described). In this regard a cam valve stop 174 will be pivoted on the housing 21 to and from its actuating positions via engagement and disengagement with the forward cam surface 140 and flat lower cam surface 142 of the cam arm 30 as it is reciprocated in the manner previously described.

With the above description of the various components and their respective functions, the overall operation of the tool assembly 12 can now be more readily understood from the discussion which follows.

D. OPERATIONAL SEQUENCE

Looking to the drawings, FIG. 1 shows the tool assembly 12 in its ready or deactuated condition. Here a fastener 22 to be installed is located in the nose assembly 50. The fastener installation section 16 has not been actuated and hence the fluid in the forward rod portion of the rear cylinder chamber 46 is at a low or atmospheric pressure; spring 80 holds the pull piston 65 and hence collet 56 at their forward positions.

The pneumatic piston and valve assembly 84 is held at its forwardmost position via pneumatic pressure in the rod end of cylinder 82. At the same time the fastener installation section 16 and cam arm 30 being connected with the piston and valve assembly 84 are also held at their forwardmost positions.

The catcher arm 34 is biased to have the catcher jaws 150 away from the nose assembly 50 and are in a position to receive the next fastener (22') from the feed tube 130. At the same time the cam follower 32 is behind the actuating surfaces of cam portion 126 on the cam arm 30 and is biased to its downward position against the set screw 135 via spring 136.

To actuate the tool assembly 12 the operator depresses a trigger 156 pivotally secured to the handle 40. This actuates the tool assembly 12 whereby hydraulic pressure is applied to the forward rod portion of rear cylinder chamber 46 causing the pull piston 65 to begin its rearward movement to set the fastener 22 (see FIG. 2). Almost simultaneously, the sorter-feeder 15 is actuated to feed the next fastener 22' into the catcher assembly 36; thus even as fastener 22 is being set the next fastener 22' is being fed to the load section 20. This provides the sorter-feeder 15 with the maximum amount of time relative to the tool cycle to prepare another fastener for feeding to the catcher assembly 36. With this construction there is no delay required for feeding and loading fasteners and the tool can be rapidly cycled.

The rearward movement of pull piston 65 continues until the flat spring 70 attached to rear piston rod 68 engages the valve actuating spool 114 closing the pneumatic exhaust port 118 and unseating the valve head portion 104 from its valve seat 102. This results in the head end of pneumatic cylinder 82 being pressurized moving the piston and valve assembly 84 rearwardly in cylinder 82. As the piston and valve assembly 84 moves axially rearwardly, it carries with it the fastener installation section 16 and the cam arm 30 (see FIGS. 3–5). This axially rearward movement is designed to continue until the nose assembly 50 of the fastener installation section 16 is located behind the catcher assembly 36. At the same time the cam follower 32 is pivoted over the cam portion 126 on cam arm 30 via engagement between the pin or roller 134 and rearward cam surface 132 (see FIGS. 4 and 5). At the end of the noted rearward travel, the cam follower 32 is located in front of the cam portion 126 of the cam arm 30. Also at the end of the travel, the valve actuating spool 114 is engaged by shoulder 120 to open the outlet port 118 and the valve head portion 104 is moved onto its valve seat 102 whereby the rod end of cylinder 82 is pressurized and the head end is vented to atmosphere (see FIG. 5). The latter event causes the piston and valve assembly 84 to move axially forwardly, carrying with it the fastener installation section 16 and the cam arm 30. This action brings the forward surface 140 into engagement with the pin or roller 134 of cam follower 32 causing the catcher arm 34 to pivotally move the catcher jaws 150 and fastener 22' in front of the nose assembly 50. This position of the catcher arm 34 and jaws 150 is maintained until the fastener 22' is inserted into the chuck jaws 58 of the nose assembly 50. After the lower cam surface 142 clears the roller 134, the catcher arm 34 is actuated via spring 126 to quickly pivot the catcher jaws 150 away from the line of travel of the nose assembly 50 with the jaws 150 opening to release the fastener 22'. When the forward travel is completed, the tool assembly 12 is ready for the installation of the fastener 22' and the sequence can be repeated.

The above sequence of operation is effectuated in conjunction with the pneumatic-hydraulic circuit 14.

E. THE PNEUMATIC-HYDRAULIC CIRCUIT 14

Looking again to the drawings, in FIG. 1 the trigger 156 is operatively associated with a pneumatic trigger valve 158 which is shown in its deactuated position. The trigger valve 158 is connected to a source 160 of pneumatic pressure via line 162 which is also connected to a pneumatic relay 164. In the deactuated position shown, the trigger valve 158 has a movable spool 166 which is biased via a spring 168 to a position blocking air from the source 160 to a line 170 leading to a cam valve 172. As will be seen, the cam valve 172 is responsive to the position of cam arm 30 via its pivotal actuation of cam valve stop 174. In the position shown the cam valve has a spool 178 located in its deactuated position; a spring 180, however, urges the spool 178 towards its actuated position.

The pneumatic relay 164 controls the actuation of fastener sorter-feeder device 15. The relay 164 has a vent line 184 connected to atmosphere and a pressure line 186 adapted to be connected to the pneumatic source 160 via line 162. The relay 164 in FIG. 1 is shown in its deactuated position with vent line 184 connecting an actuating line 188 from the sorter-feeder device 15 to atmosphere. The relay 164 in its actuated position will connect the line 188 and sorter-feeder device 15 to the pneumatic source 160 which will cause a blind fastener (22') to be fed into feed tube 130 and into the jaws 150 of catcher assembly 36.

In the condition shown in FIG. 1, both sides of the relay 164 are vented or connected to atmosphere. Thus the deactuation side of relay 164 is vented via a line 190 connected to a vent line 192 via a bore 194 and annular groove 196 in cam valve spool 178. The actuation side of relay 164 is also vented via a line 198, an annular groove 200 in cam valve spool 178, line 170, an annular groove 202 in trigger valve spool 166 and vent line 192.

A source of hydraulic pressure 204 is connected to port 75 in the fastener installation section 16 via line 206 and as shown is in its deactuated or low pressure condition. A pressure switch 108 is connected to line 198 and is responsive to a preselected high level of pneumatic pressure in line 198 to actuate the hydraulic source 204 to provide high pressure to the pull piston 65 via line 206 and port 75.

The reciprocating valve section 18, which is pneumatically actuated, receives its pneumatic pressure from source 160 via a line 210 connected to port 94 and hence, in the condition shown in FIG. 7, maintains that section 18 in its deactuated condition.

To actuate the tool assembly 12, the operator presses the trigger 156 which moves the trigger valve spool 166 to its actuated position as shown in FIG. 2. Now the line 198 is connected to the pneumatic source 160 via cam spool groove 200, line 170 and trigger spool groove 202. With line 198 pressurized the relay 164 will be shifted to its actuated position connecting pneumatic pressure to the sorter-feeder device 15 via actuating line 188 whereby fastener 22' will be transmitted into the jaws 150 of the catcher assembly 36 via tube 130.

At the same time the switch 208 will be actuated to place the hydraulic source 204 in its pressurized condition whereby fluid under pressure will be delivered to the pull piston 65 via line 206 and port 75. This initiates the fastener setting cycle.

Looking now to FIG. 2, when the reciprocating valve section 18 is actuated by the flat spring 70 via pull piston 65, the cam arm 30 will be retracted off the cam valve stop 174 whereby it can freely pivot permitting the cam valve spool 178 to be shifted to its actuated position via spring 180. In this condition, the deactuating line 190 to relay 164 will be pressurized via line 162 and the lower portion of the chamber housing the spool 178; the actuating line 198 to relay 164 will be vented via cam spool groove 200 and line 192. Now the relay 164 will be shifted to its deactuated position in which the sorter-feeder device 15 will be conditioned to a deactuated non-feed state since its input line 188 will be vented.

At the same time the pressure switch 208, in response to the loss of pneumatic pressure in line 198, will be deactuated returning the line 206 of hydraulic source 204 to its low pressure or return state. Here the pull piston 65 will be moved to return to its original position via return spring 80 which will also cause the return of the fluid to the source 204. Note that the pull piston 65 is already being returned to its original position relative to its housing member 42 while the reciprocating valve section 18 is in its actuating cycle. This provides that the collet member 56 will be returned to its original position in the nose assembly 50 permitting the tool system 10 to complete its cycle in a minimum time.

The latter condition of the pneumatic-hydraulic circuit 14 remains the same until the cam arm 30 has been moved sufficiently to its return position to engage and pivot the cam valve stop 174 to shift the cam spool 178 to its original position. With the trigger 156 now released the tool system 10 returns to its original condition shown in FIG. 1 ready for another cycle.

As can be seen from the preceding discussion the tool system 10 of the present invention is of a relatively simple and compact construction and is rapid in operation.

While it will be apparent that the preferred embodiment of the invention disclosed is well calculated to fulfill the objects previously stated and discussed, it will be appreciated that the invention is susceptible to modification, variation and change without departing from the proper scope or fair meaning of the invention.

What is claimed is:

1. In a portable tool for setting blind fasteners including a pin and a sleeve by applying a relative axial force between the pin and sleeve, said tool comprising: fastener installation means actuable for applying the relative axial force between the pin and sleeve, said installation means including a nose assembly having an open, forward end and adapted to receive the fastener at said forward end and to apply the relative axial force to the fastener, fastener loading means operable for automatically loading fasteners into said nose assembly and comprising a pivotal arm pivotably actuable to a load position locating the fastener at said forward end of said nose assembly, said pivotal arm being generally elongated and extending in a direction generally parallel to the line of travel of said reciprocable movement, and actuating means operatively connected with said fastener loading means and said installation means for actuating said pivotal arm to pivot about an axis transverse to said line of travel to said load position and for causing relative reciprocable movement between said loading means and said installation means whereby the fastener held by said loading means will be inserted into said open end of said nose assembly as said nose assembly and said loading means are moved towards each other.

2. The portable tool of claim 1 with said fastener loading means including catcher means located on said pivotal arm for releasably holding the fastener such that after insertion of the fastener into said nose assembly the fastener will be released from said catcher means by pivotal movement of said pivotal arm away from said forward end of said nose assembly.

3. The portable tool of claim 2 with said catcher means comprising at least one catcher arm mounted for pivotal movement to a first position clamping the fastener and to a second position unclamping the fastener.

4. The portable tool of claim 3 with said catcher means comprising resilient means for normally urging said catcher arm to said first position and permitting movement of said catcher arm to said second position in response to a reaction force of the fastener on said catcher arm as said pivotal arm pivots away from said nose assembly after insertion of the fastener therein.

5. The portable tool of claim 2 with said catcher means comprising a pair of catcher arms mounted for pivotal movement towards each other to a first position clamping the fastener and for pivotal movement away from each other to a second position unclamping the fastener.

6. The portable tool claim 5 with said catcher means comprising resilient means for normally urging said catcher arms to said first position and permitting movement of said catcher arms to said second position in response to a reaction force of the fastener on said catcher arms as said pivotal arm pivots away from said nose assembly after insertion of the fastener therein.

7. The portable tool of claim 1 comprising housing means for supporting said installation means for reciprocable movement, said actuating means supported by said housing means and including a reciprocable actuating piston connected to said installation means for causing the reciprocable movement of said installation means with said housing and relative to said loading means.

8. The portable tool of claim 7 with said fastener loading means comprising a cam arm mounted for reciprocable movement with said installation means by said actuating piston, said fastener loading means further comprising a cam follower connected with said pivotal arm and actuable in response to the reciprocable movement of said cam arm for pivoting said pivotal arm to said load position.

9. The portable tool of claim 8 with said installation means including a pull piston mounted for reciprocable movement in a pull direction for providing the relative axial force for setting the fastener and in a return direction in preparation for setting the next fastener, and further including circuit means actuable for providing energy to said pull piston of said installation means for applying the relative axial force to set the fastener and to said actuating piston of said actuating means, said circuit means being responsive to reciprocable movement of said cam arm to a predetermined position to release the energy for installation of the fastener to said pull piston.

10. In a portable tool for setting blind fasteners including a pin and a sleeve by applying a relative axial force between the pin and sleeve, said tool comprising: fastener installation means actuable for applying the relative axial force between the pin and sleeve, said installation means including a nose assembly having an open, forward end and adapted to receive the fastener at said forward end and to apply the relative axial force to the fastener, fastener loading means operable for automatically loading fasteners into said nose assembly and comprising a pivotal arm pivotably actuable to a load position locating the fastener at said forward end of said nose assembly, and actuating means operatively connected with said fastener loading means and said installation means for actuating said pivotal arm to said load position and for causing relative reciprocable movement between said loading means and said installation means whereby the fastener held by said loading means will be inserted into said open end of said nose assembly as said nose assembly and said loading means are moved towards each other, housing means for supporting said installation means for reciprocable movement, said actuating means supported by said housing means and including a reciprocable actuating piston connected to said installation means for causing the reciprocable movement of said installation means with said housing and relative to said loading means, said fastener loading means comprising a cam arm mounted for reciprocable movement with said installation means by said actuating piston, said fastener loading means further comprising a cam follower connected with said pivotal arm and actuable in response to the reciprocable movement of said cam arm for pivoting said pivotal arm to said load position, said installation means including a pull piston mounted for reciprocable movement in a pull direction for providing the relative axial force for setting the fastener and in a return direction in preparation for setting the next fastener, and further including circuit means actuable for providing energy to said pull piston of said installation means for applying the relative axial force to set the fastener and to said actuating piston of said actuating means, said circuit means being responsive to reciprocable movement of said cam arm to a predetermined position to release the energy for installation of the fastener to said pull piston, said circuit means being actuable to substantially simultaneously provide energy to said pull piston to install a fastener and to feed a fastener to said fastener loading means.

11. The portable tool of claim 7 further including circuit means actuable for providing energy to said installation means and to said actuating piston of said actuating means, said circuit means being selectively actuable to provide energy to said installation means for applying the relative axial force to set the fastener, said circuit means being responsive to the reciprocable movement of said installation means to a predetermined position to cause deactuation of said installation means.

12. The portable tool of claim 7 with said actuating means including valve means actuable to a first valve position for actuating said actuating piston to move said installation means away from said loading means.

13. The portable tool of claim 12 with said valve means being actuable to a second valve position for actuating said actuating piston to move said installation means towards said loading means.

14. The portable tool of claim 13 with said valve means being actuated to its second valve position in response to said actuating piston moving said installation means to a preselected clearance position away from said loading means, in said preselected clearance position said forward end of said nose assembly being spaced in clearance away from said load position of said loading means such that said pivotal arm can be pivoted to said load position locating the fastener at said forward end of said nose assembly.

15. In a portable tool for setting blind fasteners including a pin and a sleeve by applying a relative axial force between the pin and sleeve, said tool comprising: fastener installation means actuable for applying the relative axial force between the pin and sleeve, said installation means including a nose assembly having an open, forward end and adapted to receive the fastener at said forward end and to apply the relative axial force to the fastener, fastener loading means operable for automatically loading fasteners into said nose assembly and comprising a pivotal arm pivotably actuable to a load position locating the fastener at said forward end of said nose assembly, and actuating means operatively connected with said fastener loading means and said installation means for actuating said pivotal arm to said load position and for causing relative reciprocable movement between said loading means and said installation means whereby the fastener held by said loading means will be inserted into said open end of said nose assembly as said nose assembly and said loading means are moved towards each other, comprising housing means for supporting said installation means for reciprocable movement, said actuating means supported by said housing means and including a reciprocable actuating piston connected to said installation means for causing the reciprocable movement of said installation means with said housing and relative to said loading means, said actuating means including valve means actuable to a first valve position for actuating said actuating piston to move said installation means away from said loading means, said installation means including a pull piston mounted for reciprocable movement in a pull direction for providing the relative axial force for setting the fastener and in a return direction in preparation for setting the next fastener, valve actuating means connected with said pull piston for actuating said valve means to said first valve position in response to movement of said pull piston in said pull direction.

16. The portable tool of claim 15 with said valve means being actuable to a second valve position for actuating said actuating piston to move said installation means towards said loading means.

17. The portable tool of claim 16 with said valve means being actuated to its second valve position in response to said actuating piston moving said installation means to a preselected clearance position away from said loading means; in said preselected clearance position said forward end of said nose assembly being spaced in clearance away from said load position of said loading means such that said pivotal arm can be pivoted to said load position locating the fastener at said forward end of said nose assembly.

18. The portable tool of claim 15 further including circuit means actuable for providing energy to said pull piston of said installation means for applying the relative axial force to set the fastener and to said actuating piston of said actuating means, said circuit means being responsive to the reciprocable movement of said actuating piston to a preselected position to release the energy for installation of the fastener to said pull piston.

19. The portable tool of claim 18 with said circuit means being actuable to substantially simultaneously provide energy to said pull piston to install a fastener and to feed a fastener to said fastener loading means.

20. The portable tool of claim 16 with said fastener loading means comprising a cam arm mounted for reciprocable movement with said installation means by said actuating piston, said fastener loading means further comprising a cam follower connected with said pivotal arm and actuable in response to the reciprocable movement of said cam arm for pivoting said pivotal arm to said load position.

21. In a portable tool for setting blind fasteners including a pin and a sleeve by applying a relative axial force between the pin and sleeve, said tool comprising: fastener installation means actuable for applying the relative axial force between the pin and sleeve, said installation means including a nose assembly having an open, forward end and adapted to receive the fastener at said forward end and to apply the relative axial force to the fastener, fastener loading means operable for automatically loading fasteners into said nose assembly and comprising a pivotal arm pivotably actuable to a load position locating the fastener at said forward end of said nose assembly, and actuating means operatively connected with said fastener loading means and said installation means for actuating said pivotal arm to said load position and for causing relative reciprocable movement between said loading means and said installation means whereby the fastener held by said loading means will be inserted into said open end of said nose assembly as said nose assembly and said loading means are moved towards each other, said fastener loading means comprising a cam arm mounted for reciprocable movement with said installation means, said fastener loading means further comprising a cam follower connected with said pivotal arm and actuable in response to the reciprocable movement of said cam arm for pivoting said pivotal arm to said load position.

22. In a portable tool for setting blind fasteners including a pin and a sleeve by applying a relative axial force between the pin and sleeve, said tool comprising: fastener installation means actuable for applying the relative axial force between the pin and sleeve, said installation means including a nose assembly having an open, forward end and adapted to receive the fastener at said forward end and to apply the relative axial force to the fastener, fastener loading means operable for automatically loading fasteners into said nose assembly and comprising a pivotal arm pivotably actuable to a load position locating the fastener at said forward end of said nose assembly, and actuating means operatively connected with said fastener loading means and said installation means for actuating said pivotal arm to said load position and for causing relative reciprocable movement between said loading means and said installation means whereby the fastener held by said loading means will be inserted into said open end of said nose assembly as said nose assembly and said loading means are moved towards each other, circuit means actuable for providing energy to said installation means and to said actuating means, said circuit means being selectively actuable to provide energy to said installation means for applying the relative axial force to the fastener and being automatically simultaneously actuable to feed a fastener to said loading means.

23. In a portable tool for setting blind fasteners including a pin and a sleeve by applying a relative axial force between the pin and sleeve, said tool comprising:

fastener installation means having an installation cycle for applying the relative axial force between the pin and sleeve, said installation cycle comprising the period from the point of initiation of actuation of said installation means to apply the relative axial force to the point of the return of said installation means to a condition for installing another fastener, said installation means including a nose assembly having an open, forward end adapted to receive the fastener and to apply the relative axial force, fastener loading means having a fastener load cycle and being operable during said load cycle for automatically loading fasteners into said nose assembly of said installation means, actuating means responsive during and at a preselected portion of said installation cycle to initiate said fastener load cycle, said fastener loading means comprising a pivotal arm being actuable by said actuating means to position a fastener in front of said nose assembly, said actuating means operatively connected with said fastener loading means and said installation means for causing relative reciprocal movement therebetween whereby a fastener held by said loading means will move into said nose assembly as said nose assembly and said loading means are moved towards each other, said pivotal arm being generally elongated and extending in a direction generally parallel to the line of said reciprocal movement, said pivotal arm being supported to pivot about an axis transverse to the line of said reciprocal movement.

24. The portable tool of claim 23 comprising circuit means actuable for providing energy to said installation means for applying the relative axial force to set the fastener and to said actuating means to initiate and effectuate said fastener load cycle, said circuit means being responsive to a signal from said installation means after the fastener has been set to initiate and effectuate said fastener load cycle.

25. The portable tool of claim 24 with said circuit means being actuable to substantially simultaneously provide energy to said installation means to set the fastener and to effectuate feeding a fastener to said fastener loading means.

26. In a portable tool for setting blind fasteners including a pin and a sleeve by applying a relative axial force between the pin and sleeve, said tool comprising:

fastener installation means having an installation cycle for applying the relative axial force between the pin and sleeve, said installation cycle comprising the period from the point of initiation of actuation of said installation means to apply the relative axial force to the point of the return of said installation means to a condition for installing another fastener, said installation means including a nose assembly having an open, forward end adapted to receive the fastener and to apply the relative axial force, fastener loading means having a fastener load cycle and being operable during said load cycle for automatically loading fasteners into said nose assembly of said installation means, actuating means responsive during and at a preselected portion of said installation cycle to initiate said fastener load cycle, said fastener loading means comprising a pivotal arm being actuable by said actuating means to position a fastener in front of said nose assembly, said actuating means operatively connected with said fastener loading means and said installation means for causing relative reciprocal movement therebetween whereby a fastener held by said loading means will move into said nose assembly as said nose assembly and said loading means are moved towards each other, circuit means actuable for providing energy to said installation means for applying the relative axial force to set the fastener and to said actuating means to initiate said fastener load cycle, said circuit means being actuable to substantially simultaneously provide energy to said installation means to set the fastener and to effectuate feeding a fastener to said fastener loading means.

27. In a portable tool for setting blind fasteners including a pin and a sleeve by applying a relative axial force between the pin and sleeve, said tool comprising: fastener installation means actuable for applying the relative axial force between the pin and sleeve, said installation means including a nose assembly having an open, forward end and adapted to receive the fastener at said forward end and to apply the relative axial force to the fastener, fastener loading means operable for automatically loading fasteners into said nose assembly and comprising a pivotal arm pivotably actuable to a load position locating the fastener at said forward end of said nose assembly, and actuating means operatively connected with said fastener loading means and said installation means for actuating said pivotal arm to said load position and for causing relative reciprocable movement between said loading means and said installation means whereby the fastener held by said loading means will be inserted into said open end of said nose assembly as said nose assembly and said loading means are moved towards each other, said fastener loading means including catcher means located on said pivotal arm for releasably holding the fastener such that after insertion of the fastener into said nose assembly the fastener will be released from said catcher means by pivotal movement of said pivotal arm away from said forward end of said nose assembly, said catcher means comprising at least one catcher arm mounted for pivotal movement to a first position clamping the fastener and to a second position unclamping the fastener, said catcher means comprising resilient means for normally urging said catcher arm to said first position and permitting movement of said catcher arm to said second position in response to a reaction force of the fastener on said catcher arm as said pivotal arm pivots away from said nose assembly after insertion of the fastener therein, housing means for supporting said installation means for reciprocable movement, said actuating means supported by said housing means and including a reciprocable actuating piston connected to said installation means for causing the reciprocable movement of said installation means with said housing and relative to said loading means, said fastener loading means comprising a cam arm mounted for reciprocable movement with said installation means by said actuating piston, said fastener loading means further comprising a cam follower connected with said pivotal arm and actuable in response to the reciprocable movement of said can arm for pivoting said pivotal arm to said load position, said installation means including a pull piston mounted for reciprocable movement in a pull direction for providing the relative axial force for setting the fastener and in a return direction in preparation for setting the next fastener, circuit means actuable for providing energy to said pull piston of said installation means for applying the relative axial force to set the fastener and to said actuating piston of said actuating means, said circuit means being responsive to reciprocable movement of said cam arm to a predetermined position to release the energy for installation of the fastener to said pull piston, said circuit means being actuable to substantially simultaneously provide energy to said pull piston to install a fastener and to feed a fastener to said fastener loading means, said actuating means including valve means actuable to a first valve position for actuating said actuating piston to move said installation means away from said loading means, said valve means being actuable to a second valve position for actuating said actuating piston to move said installation means towards said fastener loading means, said valve means being actuated to its second valve position in response to said actuating piston moving said installation means to a preselected clearance position away from said loading means, in said preselected clearance position said forward end of said nose assembly being spaced in clearance away from said load position of said loading means such that said pivotal arm can be pivoted to said load position locating the fastener at said forward end of said nose assembly, valve actuating means connected with said pull piston for actuating said valve means to said first valve position in response to movement of said pull piston in said pull direction, said valve means comprising a valve member slidably supported within said actuating piston.

28. In a portable tool for setting blind fasteners including a pin and a sleeve by applying a relative axial force between the pin and sleeve, said tool comprising: fastener installation means actuable for applying the relative axial force between the pin and sleeve, said installation means including a nose assembly having an open, forward end and adapted to receive the fastener at said forward end and to apply the relative axial force to the fastener, fastener loading means operable for automatically loading fasteners into said nose assembly and comprising an arm member actuable to a load position locating the fastener at said forward end of said nose assembly, and actuating means operatively connected with said fastener loading means and said installation means for actuating said arm member to said load position and for causing relative reciprocable movement between said loading means and said installation means whereby the fastener held by said loading means will be inserted into said open end of said nose assembly as said nose assembly and said loading means are moved towards each other, said fastener loading means including catcher means located on said arm member for releasably holding the fastener such that after insertion of the fastener into said nose assembly the fastener will be released from said catcher means by movement of said arm member away from said forward end of said nose assembly, said catcher means comprising at least one catcher arm mounted for movement to a first position clamping the fastener and to a second position unclamping the fastener, housing means for supporting said installation means for reciprocable movement, said actuating means supported by said housing means and including a reciprocable actuating piston connected to said installation means for causing the reciprocable movement of said installation means with said housing and relative to said loading means, said fastener loading means comprising a cam arm mounted for reciprocable movement with said installation means by said actuating piston, said fastener loading means further comprising a cam follower connected with said pivotal arm and actuable in response to the reciprocable movememt of said cam arm for pivoting said pivotal arm to said load position, said installation means including a pull piston mounted for reciprocable movement in a pull direction for providing the relative axial force for setting the fastener and in a return direction in preparation for setting the next fastener, circuit means actuable for providing energy to said pull piston of said installation means for applying the relative axial force to set the fastener and to said actuating piston of said actuating means, said circuit means being responsive to reciprocable movement of said cam arm to a predetermined position to release the energy for installation of the fastener to said pull piston, said actuating means including valve means actuable to a first valve position for actuating said actuating piston to move said installation means away from said loading means, said valve means being actuable to a second valve position for actuating said actuating piston to move said installation means towards said fastener loading means, said valve means being actuated to its second valve position in response to said actuating piston moving said installation means to a preselected clearance position away from said loading means, in said preselected clearance position said forward end of said nose assembly being spaced in clearance away from said load position of said loading means such that said arm member can be moved to said load position locating the fastener at said forward end of said nose assembly, valve actuating means connected with said pull piston for actuating said valve means to said first valve position in response to movement of said pull piston in said pull direction.

29. In a portable tool for setting blind fasteners including a pin and a sleeve by applying a relative axial force between the pin and sleeve, said tool comprising: fastener installation means actuable for applying the relative axial force between the pin and sleeve, said installation means including a nose assembly having an open, forward end and adapted to receive the fastener at said forward end and to apply the relative axial force to the fastener, fastener loading means operable for automatically loading fasteners into said nose assembly and comprising an arm member actuable to a load position locating the fastener at said forward end of said nose assembly, and actuating means operatively connected with said fastener loading means and said installation means for actuating said arm member to said load position and for causing relative reciprocable movement between said loading means and said installation means whereby the fastener held by said loading means will be inserted into said open end of said nose assembly as said nose assembly and said loading means are moved towards each other, said fastener loading means including catcher means located on said arm member for releasably holding the fastener such that after insertion of the fastener into said nose assembly the fastener will be released from said catcher means by movement of said arm member away from said forward end of said nose assembly, housing means for supporting said installation means for reciprocable movement, said actuating means supported by said housing means and including a reciprocable actuating piston connected to said installation means for causing the reciprocable movement of said installation means with said housing and relative to said loading means, said installation means including a pull piston mounted for reciprocable movement in a pull direction for providing the relative axial force for setting the fastener and in a return direction in preparation for setting the next fastener, circuit means actuable for providing energy to said pull piston of said installation means for applying the relative axial force to set the fastener and to said actuating piston of said actuating means, said circuit means being responsive to reciprocable movement of said actuating piston to release the energy for installation of the fastener to said pull piston, said actuating means including valve means actuable to a first valve position for actuating said actuating piston to move said installation means away from said loading means, said valve means being actuable to a second valve position for actuating said actuating piston to move said installation means towards said fastener loading means, said valve means being actuated to its second valve position in response to said actuating piston moving said installation means to a preselected clearance position away from said loading means, in said preselected clearance position said forward end of said nose assembly being spaced in clearance away from said load position of said loading means such that said arm member can be moved to said load position locating the fastener at said forward end of said nose assembly, valve actuating means operatively connected with said installation means for actuating said valve means to said first valve position a predetermined interval after the fastener has been set.

30. A portable installation tool for setting blind fasteners including a pin and a sleeve by applying a relative axial force between the pin and sleeve comprising installation section means actuable for setting the blind fastener, said installation section means including a nose assembly having an open forward end adapted to receive the blind fastener prior to setting, said installation section means supported for movement from a clearance position permitting loading of the next fastener and to a fastener setting position at which the fastener is set, fastener loading section means for automatically front loading the fastener into said nose assembly of said installation section means and piston-valve section means for reciprocating said installation section means from said fastener setting position after a fastener has been set to said clearance position, said fastener loading section means being responsive to movement of said installation section means away from said fastener setting position to locate the next fastener to a load position in front of said nose assembly, said piston-valve section means being responsive after movement of said installation section means to said clearance position for returning said installation section means to said fastener setting position, said nose assembly receiving the next fastener into said open forward end from said fastener loading section means as said installation section means moves to said fastener setting position.

31. A portable installation tool for setting blind fasteners including a pin and a sleeve by applying a relative axial force between the pin and sleeve comprising installation section means actuable for setting the blind fastener, said installation section means including a nose assembly having an open forward end adapted to receive the blind fastener prior to setting, said installation section means supported for movement from a clearance position permitting loading of the next fastener and to a fastener setting position at which the fastener is set, fastener loading section means for automatically front loading the fastener into said nose assembly of said installation section means and piston-valve section means for reciprocating said installation section means from said fastener setting position after a fastener has been set to said clearance position, said fastener loading section means being responsive to movement of said installation section means away from said fastener setting position to locate the next fastener to a load position in front of said nose assembly, said piston-valve section means being responsive after movement of said installation section means to said clearance position for returning said installation section means to said fastener setting position, said nose assembly receiving the next fastener into said open forward end from said fastener loading section means as said installation section means moves to said fastener setting position, actuating means responsive to the fastener being set for actuating said piston-valve section means to move said installation section means to said clearance position, said actuating means being responsive to said installation section means being at said clearance position for actuating said piston-valve section to move said installation section means back to said fastener setting position, said fastener loading section means being responsive to said installation section means being at a preselected position away from said fastener setting position for moving the next fastener from a position out of line from said nose assembly to said load position, said fastener loading section means being responsive to said installation section means being in a position for receiving the next fastener for moving from said load position to said out of line position.

32. A portable installation tool for setting blind fasteners including a pin and a sleeve by applying a relative axial force between the pin and sleeve comprising installation section means actuable for setting the blind fastener, said installation section means including a nose assembly having an open forward end adapted to receive the blind fastener prior to setting, said installation section means supported for movement from a clearance position permitting loading of the next fastener and to a fastener setting position at which the fastener is set, fastener loading section means for automatically front loading the fastener into said nose assembly of said installation section means and piston-valve section means for reciprocating said installation section means from said fastener setting position after a fastener has been set to said clearance position, said fastener loading section means being responsive to movement of said installation section means away from said fastener setting position to locate the next fastener to a load position in front of said nose assembly, said piston-valve section means being responsive after movement of said installation section means to said clearance position for returning said installation section means to said fastener setting position, said nose assembly receiving the next fastener into said open forward end from said fastener loading section means as said installation section means moves to said fastener setting position, actuating means responsive to the fastener being set for actuating said piston-valve section means to move said installation section means to said clearance position, said actuating means being responsive to said installation section means being at said clearance position for actuating said piston-valve section to move said installation section means back to said fastener setting position, said fastener loading section means being responsive to said installation section means being at a preselected position away from said fastener setting position for moving the next fastener from a position out of line from said nose assembly to said load position, said fastener loading section means being responsive to said installation section means being in a position for receiving the next fastener for moving from said load position to said out of line position, fastener feed means for feeding a next fastener to said fastener loading section means while in said out of line position, and means for actuating said installation section means to set the fastener and substantially simultaneously actuating said fastener feed means to feed the next fastener to said fastener loading section.

* * * * *

UNITED STATES PATENT AND TRADEMARK OFFICE

CERTIFICATE OF CORRECTION

PATENT NO. : 4,604,889

DATED : August 12, 1986

INVENTOR(S) : Boris P. Sukharevsky

It is certified that error appears in the above-identified patent and that said Letters Patent is hereby corrected as shown below:

Column 1, line 59, delete "vided" and substitute therefor --vide--.

Column 4, line 60, delete "hudraulic" and substitute therefor --hydraulic--.

Column 5, line 14, delete "hudraulic" and substitute therefor --hydraulic--.

Column 6, line 25, delete "114" and substitute therefor --70--.

Column 6, line 34, delete "pneuamtic" and substitute therefor --pneumatic--.

Column 7, line 68, delete "dwonwardly" and substitute therefor --downwardly--.

Column 9, line 24, after "forward" insert --cam--.

Column 10, line 12, delete "108" and substitute therefor --208--.

Signed and Sealed this

Seventeenth Day of March, 1987

*Attest:*

DONALD J. QUIGG

*Attesting Officer*

*Commissioner of Patents and Trademarks*